United States Patent [19]

Goto

[11] 4,102,631

[45] Jul. 25, 1978

[54] BATTERY OPERATED LIGHTER EQUIPPED WITH A BATTERY OPERATED TIMEPIECE

[75] Inventor: Kenjiro Goto, Urawa, Japan

[73] Assignee: Mansei Kogyo Kabushiki Kaisha, Saitama, Japan

[21] Appl. No.: 754,003

[22] Filed: Dec. 27, 1976

[30] Foreign Application Priority Data

Dec. 27, 1975 [JP] Japan ..... 50-178952[U]

[51] Int. Cl.[2] ..... F23Q 2/32

[52] U.S. Cl. ..... 431/253; 58/23 BA; 58/53; 58/152 R; 58/88 R

[58] Field of Search ..... 431/255, 253, 125, 132, 431/135; 58/23 BA, 53, 54, 55, 56, 152 R, 88 R, 88 G, 88 E

[56] References Cited

U.S. PATENT DOCUMENTS

| | | | |
|---|---|---|---|
| 2,577,679 | 12/1951 | Fraser | 431/253 |
| 3,811,819 | 5/1974 | Toiseux | 431/255 |
| 3,816,056 | 6/1974 | Brown | 431/253 |
| 4,003,198 | 1/1977 | Morokawa | 58/152 R |

*Primary Examiner*—Edward G. Favors

*Attorney, Agent, or Firm*—Oblon, Fisher, Spivak, McClelland & Maier

[57] ABSTRACT

A battery operated lighter equipped with a battery operated timepiece which includes a lighter ignition circuit and a timepiece circuit wherein a switch is used in common for selectively manipulating the lighter ignition circuit or the timepiece circuit.

18 Claims, 4 Drawing Figures

BATTERY OPERATED LIGHTER EQUIPPED WITH A BATTERY OPERATED TIMEPIECE

BACKGROUND OF THE INVENTION

Field of the Invention

The present invention relates to an improved battery operated lighter equipped with a battery operated timepiece, and more particularly to an improved switching device therefor.

Description of the Prior Art

Heretofore, there have been disclosed various kinds of lighters of this type. However, many of them simply combined a lighter mechanism with a timepiece mechanism within a casing. Therefore, there was no organic relation between the lighter mechanism and the timepiece mechanism. Further there was not provided any organic switching device which is commonly used for operating the lighter and the timepiece. As a result, they were not suitable for practical use.

SUMMARY OF THE INVENTION

It is therefore, an object of the present invention to provide an improved battery operated lighter equipped with a battery operated timepiece which is highly suitable for practical use.

Another object of the present invention is to provide such a battery lighter equipped with a battery timepiece both operated by a single manual operator.

A further object of the present invention is to provide an improved switching device for the battery lighter and for the battery timepiece which is easy for operation, secure and practical.

Yet another object of the present invention is to provide such a switching device which is operated to selectively actuate the battery lighter and the time indication of the battery timepiece.

Yet another object of the present invention is to provide a switching device of the type in which a switch contact is moved in accordance with the opening and the closing movement of a lighter cap, wherein on opening of the lighter cap, the manual operator operates the battery lighter only and on closing of the lighter cap, the manual operator operates the time indication of the battery timepiece only.

According to the present invention, there is provided a battery operated lighter equipped with a battery operated timepiece comprising a casing; a fuel tank for maintaining a gas fuel; a burner nozzle for issuing the gas fuel from said fuel tank; a lighter ignition circuit for generating a spark at the burner nozzle; a timepiece circuit having a time indication unit; a battery for supplying electric energy to the lighter ignition circuit and timepiece circuit; a switch used in common for manipulating the two circuits and including a first, second and third contacts; and a control means provided in mechanical connection with the switch, wherein the first and second switch contacts are adapted to close the lighter ignition circuit and wherein the positional relationship of these first and second switch contacts is controlled by the control means so that one of the first and second switch contacts may selectively be brought into contact with the third switch contact to manipulate the timepiece circuit.

BRIEF DESCRIPTION OF THE DRAWINGS

The invention will now be described in greater detail hereinafter by way of example with respect to the accompanying drawings in which.

DETAILED DESCRIPTION OF THE DRAWINGS

Figure 1:
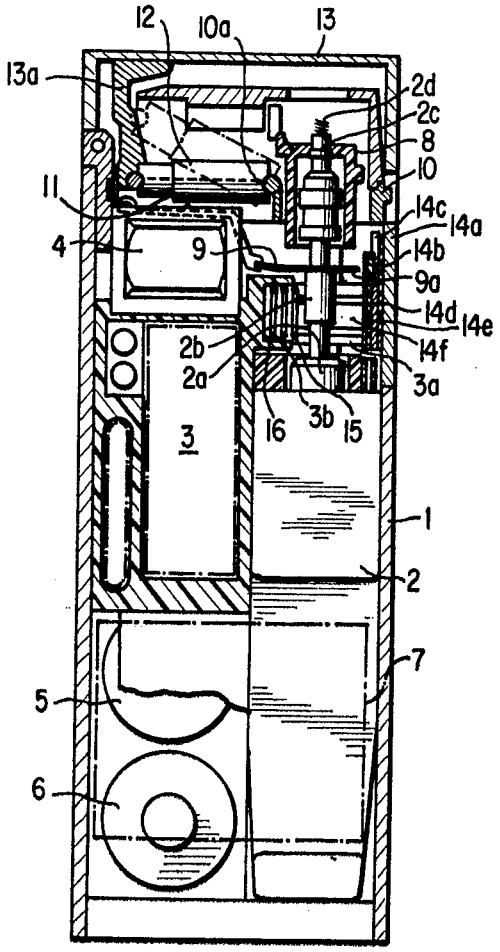
FIG. 1 is an elevational view partially in section of a preferred embodiment according to the present invention showing a battery lighter equipped with a battery timepiece.
Figure 2:
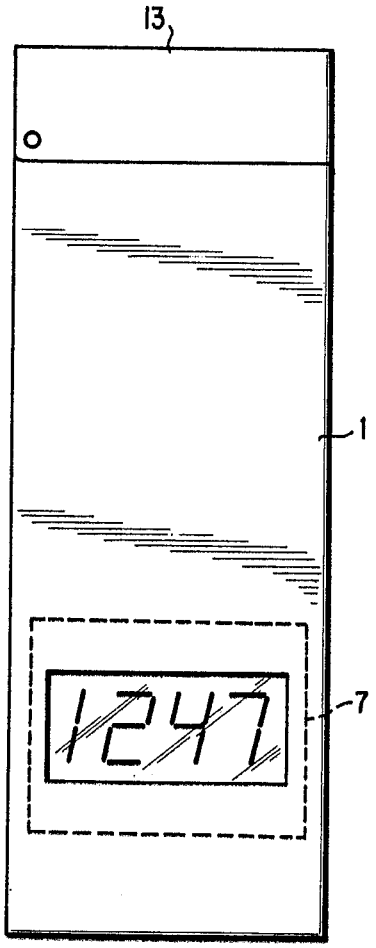
FIG. 2 is an external appearance of the lighter as shown in FIG. 1.
Figure 3:
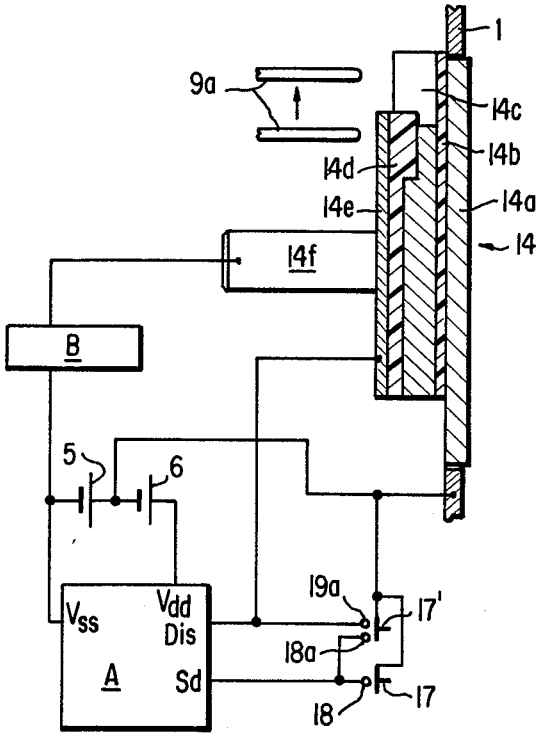
FIG. 3 is an essential part of one embodiment of a switching device for the lighter as shown in FIG. 1.

Referring now to FIGS. 1 to 3, a casing 1 of electrically conductive material has juxtaposingly arranged therein a fuel tank 2 and an ignition unit 3 housing therein the component parts which constitute an ignition circuit for a battery lighter. A step-up transformer 4 which is adapted to discharge ignition sparks is mounted above said ignition unit 3. Said ignition unit 3 and said step-up transformer 4 constitute a lighter ignition circuit B which will be explained later with respect to FIG. 3.

Two silver oxide cells 5, 6 are arranged under said ignition unit 3 as an electric energy supplying source. A positive pole of said cell 5 is electrically connected to said casing 1. At one side of both said fuel tank 2 and said ignition unit 3, there is arranged a well-known time indication unit 7 which is adapted to digitally indicate time by means of a light emitting diode through an indication window formed on one side of said casing 1.

On said fuel tank 2 is mounted a burner valve assembly which comprises a valve body **2*a*, a hollow cylindrical tube 2*b* of electrical insulation, an electrically conductive nozzle 2*c* and a nozzle cover 8 of electrical insulation. Said valve body 2*a* is normally biased upwards by a spring (not shown) arranged therein. Said nozzle 2*c* has arranged at the upper part thereof an electrically conductive coiled wire 2*d* for obtaining the optimum mixture of gaseous fuel with the air. Said coiled wire 2*d* is electrically connected to one of terminals of a secondary side of said step-up transformer 4 and serves as one of the spark electrodes to form the spark gap. The other spark electrode (not shown) is electrically connected to the other terminal of said secondary side of said step-up transformer 4**.

A valve control plate 9 is pivotably engaged at one end thereof with a supporting frame 10 of electrically conductive material which is fixedly mounted on the upper portion of said casing 1. Said valve control plate 9 is engaged at the other end thereof with said hollow cylindrical tube **2*b*. Said valve control plate 9 is made of electrically conductive material and is electrically connected to said positive pole of said cell 5 through said electrically conductive casing 1. Said valve control plate 9 is electrically insulated through said tube 2*b* from said nozzle 2*c*. Said valve control plate 9 is provided at the center portion thereof with an upwardly extending projection 11 of electric insulation on which abuts a cylinder 12 comprising a pair of telescopically connected cylindrical members between which is received a coiled spring (not shown). Said cylinder 12 is engaged at one end thereof with a depending piece 13***a* on the internal surface of a pivotal cap 13 and at the other end thereof with a projection 10*a* of said supporting frame 10 serving as a pivot of said cylinder 12. The pivotal movement of said cap 13 is facilitated by the movement of said cylinder 12. Said cylinder 12 normally depresses through said projection 10*a* said valve control plate 9 to its inoperative position and travels in accordance with the opening movement of said pivotal cap 13 to release said valve control plate 9 from depression thereof so that said valve control plate 9 may travel upwards into an operative position thereof under the influence of said spring arranged in said valve body 2*a*. Thus, upward and downward movement of said valve control plate 9 is effected through said cylinder 12 in accordance with the opening and the closing movement of said pivotal cap 13. A first switching contact S1 is disposed on the front end 9*a* of said valve control plate 9. Therefore, said front end 9*a* of said valve control plate 9 i.e. said first switching contact S1, moves upwards and downwards in accordance with the opening and the closing movement of said pivotal cap 13 and becomes possible to selectively contact a second switching contact S2 used for operating the lighter or a third switching contact S3 used for operating the time indication of the timepiece, both of which are disposed on a single manual operator 14. Said pivotal cap 13 functions as a controlling means for controlling said upward and downward movement of said front end 9*a* of said valve control plate 9 i.e. said first switching contact S1. This will be explained in detail hereinafter.

A manual operator 14 is arranged on one side of said casing 1 in facing said front end 9*a* of said valve control plate 9. Said manual operator 14 has arranged thereon a thumb piece 14*a* of electrically conductive material, the external surface thereof is substantially flush with the external surface of said casing 1. Said manual operator 14 has arranged thereon a first electrically conductive plate 14*c* which is sticked on the inner side of said thumb piece 14*a* and a first electrically insulative plate 14*b* is arranged between said thumb piece 14*a* and said first electrical plate 14*c*. Said manual operator 14 further has arranged thereon a second electrically conductive plate 14*e* which is sticked on the inner side of said first electrical plate 14*c* and a second electrically insulative plate 14*d* is arranged between said first and second electrical plates 14*c*, 14*e*. A second switching contact S2 for use in operating the lighter is disposed on said first electrical plate 14*c*. A third switching contact S3 for use in operating the time indication of the timepiece is disposed on said second electrical plate 14*e*. Additionally, said manual operator 14 has arranged thereon an extending leg 14*f* of electrically conductive material which inwardly extends from said first electrical plate 14*c*. Said extending leg 14*f* is electrically insulated from said second electrical plate 14*e*.

At the upper part of said ignition unit 3, there is provided a laterally extending guide 3*a* which has a recess 3*b* for receiving therein a coiled metallic spring 15 (hereinafter called a return spring). Said return spring 15 is in electrical contact with said leg 14*f* and engages said leg 14*f* so as to normally bias said manual operator 14 to its inoperative position. Said manual operator 14 is horizontally reciprocable along said guide 3*a* which has a groove (not shown) formed so as to correspond in shape to said leg 14*f* of said operator 14. As a result, both said first electrical plate 14*c* i.e. said second switching contact S2 and said second electrical plate 14*e* i.e. said third switching contact S3 are horizontally moved toward said front end 9*a* of said valve control plate 9 i.e. said first switching contact S1 when said manual operator 14 is moved to its operative position. Further, as more clearly shown in FIG. 3, an upper end of said first electrical plate 14*c* is arranged to protrude beyond the upper end of both said second electrical plate 14*e* and said second electrically insulative plate 14*d*. According to the present embodiment shown in FIG. 3, the contact surface of said first electrical plate 14*c* is stepped back from said second electrical plate 14*e*. However, both of the contact surfaces of said first and second plate 14*c*, 14*e* may be arranged on the same plane and within the same distance from said front end 9*a* of said valve control plate 9. An electrically conductive plate 16 is positioned on the bottom of said recess 3*b* of said guide 3 to contact the other end of said return spring 15. As the arrangement is made in the above described manner, when said pivotal cap 13 is opened, said valve control plate 9 travels upwards to its operative position. Then, when said manual operator 14 is pushed inwardly toward its operative position, said first electrical plate 14*c* contacts said front end 9*a* of said valve control plate 9. On the other hand, when said pivotal cap 9 is in its closed position, said valve control plate 9 is positioned in its inoperative position. Then, when said manual operator 14 is pushed inwardly toward its operative position, said second electrical plate 14*e* contacts said front end 9*a* of said valve control plate 9. Said front end 9*a* of said valve control plate 9, said first electrical plate 14*c* and said second electrical plate 14*e* constitute a switch for a lighter ignition circuit and for a time indication circuit of a timepiece circuit which will be explained below.

FIG. 3 shows a block diagram showing a lighter ignition circuit B and a timepiece circuit A in relation to said switching contacts. First, a lighter ignition circuit B will be explained. Said lighter ignition circuit B has a primary side and a secondary side thereof. The secondary side of said lighter ignition circuit B corresponds to the secondary side of said step-up transformer 4 which was described before. One of terminals of the primary side of said lighter ignition circuit B is electrically connected to a negative pole of said cell 5. A positive pole of said cell 5 is electrically connected to said front end 9*a* of said valve control plate 9 through said casing 1 and said supporting frame 10. The other terminal of the primary side of said lighter ignition circuit B is electrically connected to said electrically conductive plate 16 received in said guide 3 by means of a lead wire (not shown) and is connected to said first electrical plate 14*c* through said return spring 15 which abuts on said electrically conductive plate 16. Therefore, only one of said cells 5 is used for said lighter ignition circuit B. Further, said front end 9*a* of said valve control plate 9 and said first electrical plate 14*c* of said manual operator 14 constitute a switch for actuating said lighter ignition circuit B.

Next, a time piece circuit A for the timepiece will be explained. Said timepiece circuit A is made up of a CMOS circuit and a time indication circuit. Said CMOS circuit comprises an oscillator, a frequency driver and a counter. Said time indication circuit comprises a light emitting diode (hereinafter called LED), a driver for driving said LED and a control circuit for controlling said driver. Said two cells 5,6 are connected to a $V_{ss}$ terminal and to a $V_{dd}$ terminal. Said CMOS circuit is directly connected to said cells 5,6 and is always in operative condition. Said CMOS circuit consumes low electric power. On the other hand, with respect to said time indication circuit, a positive pole of said cell 5 and a negative pole of said cell 6 are connected to said front end 9*a* of said valve control plate 9 through said casing 1. A time indication terminal Dis is connected to said second electrical plate 14*e*. Said front end 9*a* of said valve control plate 9 and said second electrical plate 14*e* of said manual operator 14 constitute a switch for operating said time indication circuit of said time piece circuit A. Further, time piece circuit A is provided with a time adjusting device. This time adjusting device serves two functions. One of them is to advance hours by completing the electrical connection between a control terminal point 17 running from said cells 5,6 and a S*d* terminal end 18. The other is to adjust minutes. For this purpose another control terminal 17' is brought into contact with said Dis terminal end 19*a* and said S*d* terminal end 18*a* both from said timepiece circuit A.

The operation of the above described lighter equipped with the timepiece will now be explained. When the user want to use a lighter, said pivotal cap 13 is first opened. Said cylinder 12 pivots around said projected portion 10*a* for the clock-wise direction to release said valve control plate 9 from the depression thereof. Then, said valve control plate 9 travels upwards along the contact surfaces of said first and second electrical plate 14*c*, 14*e* to its operative position under the influence of said spring arranged in said valve body 2*a* so that said nozzle 2*c* may be moved upwards by said spring of said valve body 2*a* to permit a gaseous fuel to issue therefrom. On the other hand, when said manual operator 14 is pushed horizontally towards its operative position, said first electrical plate 14*c* thereof contacts said front end 9*a* of said valve control plate 9. As a result, said first switching contact S1 on said front end 9*a* of said valve control plate 9 contacts said second switching contact S2 on said first electrical plate 14*c*. As a result, said lighter ignition circuit B is operated. Thus, electric sparks are generated at said spark gap to ignite the gaseous fuel issued from said nozzle 2*c*. In this case, said time indication circuit of said timepiece circuit A is not operated. In accordance with the closing movement of said pivotal cap 13, said cylinder 12 is returned to its initial position to depress said valve control plate 9 so that said valve control plate 9 may be returned to its initial inoperative position to close said valve. Then, issurance of the gaseous fuel is stopped. When the user wants to use a timepiece, said pivotal cap 13 is maintained in its closed position. Therefore, said valve control plate 9 is also maintained in its initial inoperative position by the depression of said cylinder 12. When said manual operator 14 is pushed horizontally toward its operative position, said second electrical plate 14*e* contacts said front end 9*a* of said valve control plate 9. As a result, said time indication circuit of said timepiece circuit A is operated to indicate time through said indication window. In this case, said lighter ignition circuit B is not operated. The adjustment of indicated time will be carried out in such a manner as described before.

Figure 4:
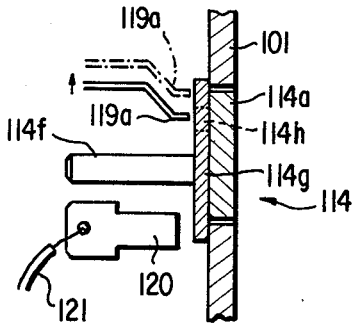
FIG. 4 is also an essential part of a second embodiment of a switching device for the lighter as shown in FIG. 1.

FIG. 4 shows a second embodiment of a switch for the lighter ignition circuit B and for the time indication circuit of said timepiece circuit A. Reference numeral 101 designates a casing of electrically conductive material. A manual operator is designated by a reference numeral 114. Said manual operator 114 has arranged thereon a thumb piece 114*a* of electrically conductive material. Said manual operator 114 further has arranged thereon an electrically conductive plate 114*g* which is sticked on the inner side of said thumb piece 114*a*. Additionally, said manual operator 114 has arranged thereon an extending leg 114*f* which extends inwardly from said electrically conductive plate 114*g*. Said manual operator 114 has a groove 114*h* which is formed on said electrically conductive plate 114*g*. Reference numeral 119 shows a valve control plate having a front end 119*a*. Reference numeral 120 shows a fixed lug plate of electrically conductive material which is connected to said time indication circuit of said timepiece circuit A by a lead wire 121. These and other components and arrangement thereof are similar or correspond to those described in FIGS. 1 to 3. However, in this embodiment, said first switching contact S1 is disposed on said electrically conductive plate 114*g* of said manual operator 114. Said second switching contact S2 is disposed on said front end 119*a* of said valve control plate 119. Said third switching contact S3 is disposed on said fixed lug plate 120. Therefore, said electrically conductive plate 114*g* of said manual operator 114 and said front end 119*a* of said valve control plate 119 constitute a switch for said lighter ignition circuit B. Said electrically conductive plate 114*g* of said manual operator 114 and said fixed lug plate 120 constitute a switch for said time indication circuit of said timepiece circuit A.

In operation, when the user want to use a lighter, said valve control plate 119 travels upwards to its operative position on opening of said pivotal cap 1. When said manual operator 114 is pushed horizontally towards its operative position, said electrically conductive plate 114*g* contacts said front end 119*a* of said valve control plate 119. As a result, said lighter ignition circuit B is operated. In this case, said time indication circuit of said timepiece circuit A is not operated. Said electrically conductive plate 114*g* does not come into contact with said fixed lug plate 120 due to the distance between said electrically conductive plate 114*g* and said fixed lug plate 120. When the user want to use a timepiece, said valve control plate 119 is returned to its initial inoperative position by the closing of said pivotal cap 1. When said manual operator 114 is pushed horizontally in the same manner as above, said front end 119*a* of said valve control plate 119 is received in said groove 114*h* of said electrically conductive plate 114*g*. When said manual operator 114 is further pushed inwardly, said electrically conductive plate 114*g* thereof contacts said fixed lug plate 120. As a result, said time indication circuit of said timepiece circuit A is operated in such a way as described before. In this case, said front end 119*a* of said valve control plate 119 is arranged not to contact the inner surface of said thumb piece 114*a* of said manual operator 114. Further, in this case, said lighter ignition circuit B is not operated.

As explained so far, said switch is used for the lighter equipped with the timepiece which is provided with said pivotal cap 1. However, the idea of this invention may be used in a complete and ideal manner without using such a pivotal cap. For example, an actuating lever may be provided at a suitable place in a lighter structure in stead of the pivotal cap and this lever may be used to actuate the switching movement of the valve control plate.

Obviously, other numerous modifications and variations of the present invention are possible in lighter of the above teachings. It is therefore to be understood that within the scope of the appended claims the invention may be practiced otherwise than as specifically described herein.

What is claimed as new and desired to be secured by patent of the United States is:

1. A battery operated lighter equipped with a battery operated timepiece comprising:
a casing;
a fuel tank for maintaining a gas fuel;
a burner nozzle for issuing the gas fuel from said fuel tank;
a lighter ignition circuit for generating a spark at said burner nozzle;
a timepiece circuit having a time indication unit;
a battery for supplying electric energy to said lighter ignition circuit and said timepiece circuit;
a switch used in common for manipulating said two circuits and including a first, second and third switch contacts;
and
a control means provided in mechanical connection with said switch, wherein said first and second switch contacts are adapted to close said lighter ignition circuit and wherein the positional relationship of these first and second switch contacts is controlled by said control means so that one of said first and second switch contacts may selectively brought into contact with said third switch contact to manipulate said timepiece circuit.

2. A lighter as set forth in claim 1, wherein
one of said three switch contacts which constitute said switch is arranged in opposed relation with said other two switch contacts and wherein the two different ways of electrical connection between these opposed switch contacts may be effected under the control of said control means.

3. A lighter as set forth in claim 2, wherein
the positional relation between said first and second switch contacts is controlled through said control means which displaces one of said switch contacts along the contact surface of the other switch contact.

4. A lighter as set forth in claim 3, wherein
said second switch contact is arranged under the control of said control means to come into contact with said first switch contact when said second switch contact is displaced by said control means.

5. A lighter as set forth in claim 4, wherein
a manual operator is provided on said casing and reciprocates linearly upon applying a manual pressure thereon and wherein said first switch contact is formed on said manual operator.

6. A lighter as set forth in claim 5, comprising
said manual operator including a leg which extends inwardly from said first switch contact and a guide adapted to receive said leg so as to facilitate the reciprocable movement of said manual operator.

7. A lighter as set forth in claim 6, wherein
a valve control means is movably arranged under the control of said control means in engagement with said burner nozzle and wherein said second switch contact is provided on said valve control means.

8. A lighter as set forth in claim 7, wherein
said valve control means consists of an electrically conductive plate whose extreme end forms said second switch contact.

9. A lighter as set forth in claim 8, wherein
said control means consists of a cap pivotably arranged on said casing with which said valve control means is disposed in operative engagement to open and close said burner nozzle.

10. A lighter as set forth in claim 9, wherein
the opening movement of said cap is displaces said second switch contact to the position where said second switch contact may be brought into contact with said first switch contact on said manual operator.

11. A lighter as set forth in claim 10, wherein
said third switch contact is provided in parallel with said first switch contact on said manual operator.

12. A lighter as set forth in claim 11, wherein
said third switch contact is attached on said first switch contact through an electrically insulative material arranged therebetween.

13. A lighter as set forth in claim 12, wherein
said first switch contact extends longitudinally beyond said third switch contact.

14. A lighter as set forth in claim 8, wherein
said first switch contact is provided with a cutout to receive said extreme end of said valve control means without touching with the latter.

15. A lighter as set forth in claim 14, wherein
said cutout is a groove formed on the surface of said first switch contact.

16. A lighter as set forth in claim 15, wherein
said valve control means under the control of said control means moves in and out of said groove of said first switch contact.

17. A lighter as set forth in claim 16, wherein
said second switch contact is formed between said third switch contact and said first switch contact.

18. A lighter as set forth in claim 17, wherein
said valve control means is displaced by the action of said control means and wherein the distance between said first switch contact and the displaced valve control means prevents said first switch contact from the contact with said third switch contact.

* * * * *

UNITED STATES PATENT AND TRADEMARK OFFICE

CERTIFICATE OF CORRECTION

PATENT NO. : 4,102,631

DATED : July 25, 1978

INVENTOR(S) : KENJIRO GOTO

It is certified that error appears in the above-identified patent and that said Letters Patent are hereby corrected as shown below:

Column 7, line 26, after "may" insert --be--.

Column 8, line 18, delete "is".

Signed and Sealed this

*Third* Day of *July 1979*

[SEAL]

*Attest:*

*Attesting Officer*

LUTRELLE F. PARKER

*Acting Commissioner of Patents and Trademarks*